United States Patent [19]

Eisen

[11] Patent Number: 4,700,635

[45] Date of Patent: Oct. 20, 1987

[54] CONSOLE-HOUSED TRAY TABLE SET

[75] Inventor: Leonard Eisen, Greenwich, Conn.

[73] Assignee: Allen Classics, Ltd., North Caldwell, N.J.

[21] Appl. No.: 836,113

[22] Filed: Mar. 4, 1986

[51] Int. Cl.[4] ..... A47B 7/02

[52] U.S. Cl. ..... 108/91; 108/50; 108/119; 312/237; 312/330 R

[58] Field of Search ..... 312/237, 330 R; 108/50, 108/91, 119; 211/133

[56] References Cited

U.S. PATENT DOCUMENTS

| | | | |
|---|---|---|---|
| 67,406 | 8/1867 | Brown | 108/119 |
| D. 180,599 | 7/1957 | Jacoby . | |
| 1,743,972 | 1/1930 | Krummes | 108/119 |
| 2,430,049 | 11/1947 | Flory | 108/91 X |
| 2,679,443 | 5/1954 | Gaines . | |
| 3,083,066 | 3/1963 | Bedol | 108/50 |
| 3,270,693 | 9/1966 | Lind . | |
| 3,311,071 | 3/1967 | Cook | 108/119 |
| 3,554,625 | 1/1971 | Sly, Jr. . | |
| 4,069,769 | 1/1978 | Abrams . | |

FOREIGN PATENT DOCUMENTS

| | | | |
|---|---|---|---|
| 84336 | 7/1983 | European Pat. Off. | 312/237 |
| 2918222 | 11/1980 | Fed. Rep. of Germany | 313/330 R |
| 1240951 | 7/1971 | United Kingdom | 108/91 |

OTHER PUBLICATIONS

Liss, Plan of the Month–Nested Tables in a Chest, Popular Mechanics, vol. 97, Issue 4, pp. 184–185, Pub. Date 4/1952.

*Primary Examiner*—Kenneth J. Dorner
*Assistant Examiner*—Thomas A. Rendos
*Attorney, Agent, or Firm*—William J. Daniel

[57] ABSTRACT

A console-housed tray table set including a console cabinet having a solid top wall, solid opposite side walls and a front wall, said front wall having a plurality of slot-like openings therein extending horizontally between said side walls and arranged in vertically stacked spaced relation; and a corresponding plurality of tray tables removably stored one by one within said horizontal slot-like openings. The tray tables each have a solid top panel of a width adapted to be received within a slot-like opening, a front panel connected to the front end of the top panel at right angles thereto and having an area at least generally coextensive the corresponding slot-like opening so as to close the same when the tray table is stored within the cabinet, and front and back sets of legs pivotally connected beneath the top panel for swinging movement from a generally downwardly directed erected position to a collapsed position with the legs lying generally horizontally beneath the top panel for storage in the cabinet opening.

8 Claims, 4 Drawing Figures

T
45
43a
43
57
41
47
63
59
61
53
51
55
65
65
65
4
4

11
1
C
67
13, 15
T
23
T
23
T
41
43
41
43
21
43
21
43
69
47
69
47
47
47
27
25
29
1
33
19

CONSOLE-HOUSED TRAY TABLE SET

FIELD OF THE INVENTION

This invention relates to the field of furniture and is concerned more particularly with a tray table set which is housed or stored within a commode or console cabinet and which when so stored gives a combination resembling in external appearance a conventional commode or console except that the traditional drawers thereof are replaced by a plurality of removable and erectable tray table units.

BACKGROUND OF THE INVENTION

Tray table sets are a common and useful item of occasional furniture, providing relatively small individual foldable tables for serving food, beverages or the like while entertaining guests or viewing television. Generally, these tray table sets include a plurality of individual tables, say 4–6 in number, each consisting of a top tray to which legs are hingedly connected in depending relation so as to be foldable to a generally flat condition adjacent the underneath of the trays. A stand or rack is typically provided onto which the plurality of trays in their folded flat condition can be engaged for storage together as a unit. Thus, the stand or rack can be lifted with the plural tray tables engaged thereon for transportation from one location to another. Such an arrangement is exemplified in U.S. Pat. No. 3,270,693. It is also known to vertically stack a plurality of trays having short rigid feet extending downwardly therefrom in metal racks as is depicted in U.S. Pat. No. Des. 180,599.

In U.S. Pat. No. 4,069,769 a tray table set is integrated into a cube-type table structure in which two vertically extending segments of the cube body are removed, except for bridging portions which hold the remaining cube sections together, and the spaces thereby defined are adapted to be occupied by vertically oriented tray tables. The individual tray tables include a top panel with a depending skirt extending around at least three sides of its sides and have the same dimensions in both length, width and thickness as the segments cut away from the base cube. When inserted in such openings, they complete the exterior contour of the cube body along both its top and opposite side walls. Legs are hingedly connected to the corners of the individual tray table units, being foldable into a flat position contained within the skirt thereof and erectable into generally downwardly directed direction so as to support the top panel above the floor or other supporting surface. The base surface of the cube body is finished to allow it, with the tray tables in place therein, to be inverted to present a finished table surface.

Commode or console cabinets containing a plurality of removable drawers are, of course, notoriously common in the furniture field, typified by spool chests or the like that were employed for housing fabric or dry goods shops over at least the last century a stock of spools of thread. These drawers could be designed for other purposes such as the display of valuable collectors' items as is illustrated by U.S. Pat. No. 3,554,625. Finally, it is known in the art to house a multiple panel extension table within a commode or console cabinet, one such arrangement being found in U.S. Pat. No. 2,679,443.

STATEMENT OF OBJECTS

The object of the present invention is to provide a combined commode and tray table set which can be designed and constructed to resemble traditional commodes with drawers, wherein the drawers are replaced by tray table units capable of removal from the commode and erection into leg-supported tray tables in the same manner as ordinary tray tables.

Another object of this invention is a combined commode and tray table set in which each tray table carries supporting legs consisting of front and back sets of legs which are pivotally connected together intermediate their respective lengths in scissors fashion, the top end of the front leg set being pivoted on a fixed axis beneath the top panel of the tray table adjacent its front panel while the top end of the other set is slidable beneath the top panel to permit the legs to undergo swinging movement between erected and collapsed positions.

BRIEF DESCRIPTION OF THE DRAWINGS

These and other objects of the invention will now be described in more complete detail in conjunction with the accompanying drawings, in which.

DESCRIPTION OF PREFERRED EMBODIMENT

Figure 1:
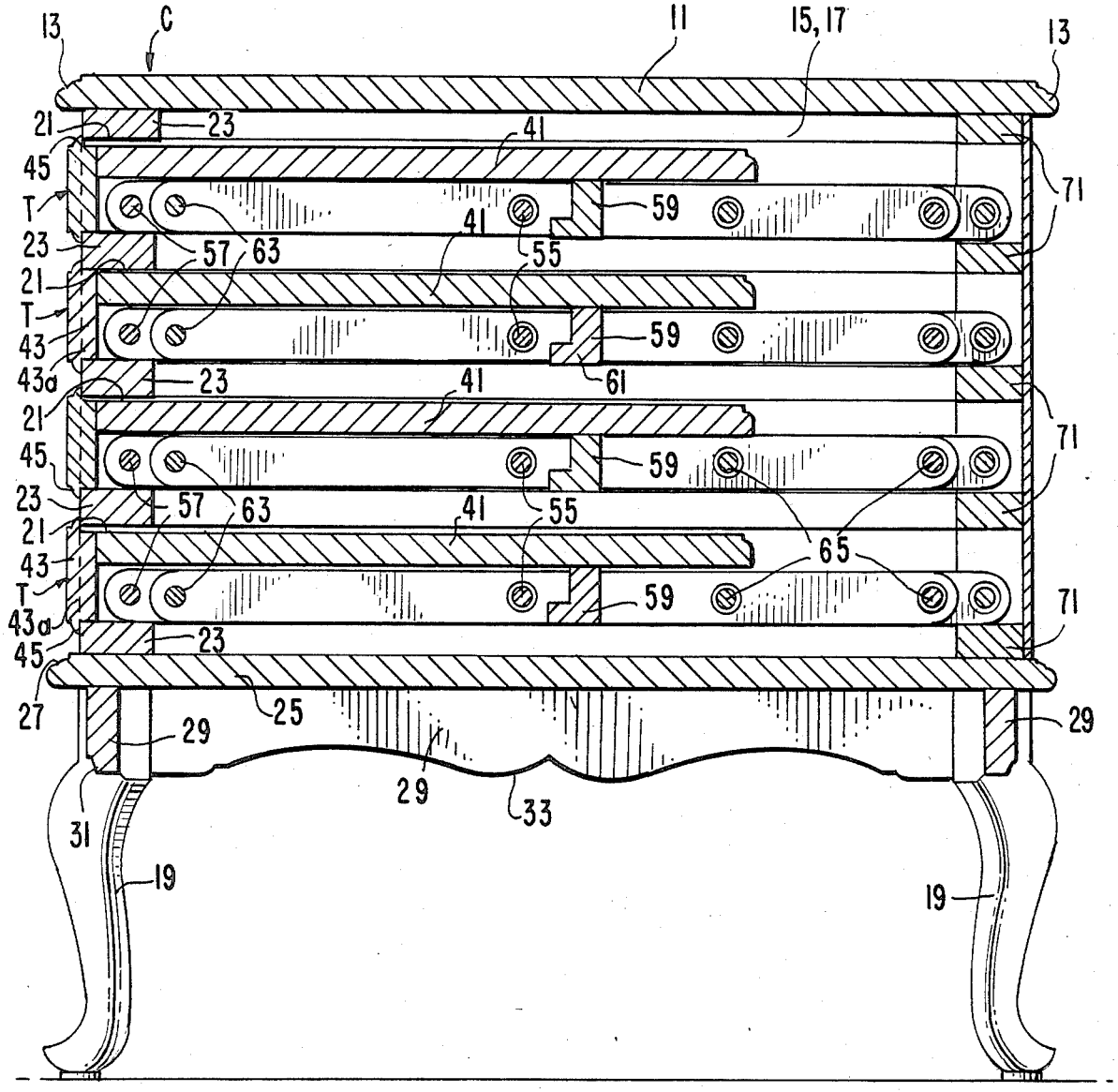
FIG. 1 vertical cross-sectional view of the combined commode and tray table set of the invention taken transversely from front to back generally along lines 1—1 of FIG. 2.

The combined console and tray table set of the present invention basically includes the console cabinet itself together with a plurality; namely, four as illustrated, of individual tray table units. In its design and construction, the console or commode cabinet of the present invention can be similar in all significant respects to traditional consoles or commodes designed for housing a plurality of removable drawers, except that the proportion of the depth of the cabinet to its width is preferably altered by increasing the depth so as to accommodate the extended length of the tray tables when collapsed for storage. Consequently, only the most general description of the cabinet need be furnished here. Thus, the console or commode cabinet generally designated C includes a top wall 11 which may be bevelled around at least its front and side peripheral edges as at 13 for ornamental purposes. The top wall is ordinarily solid as is usual for such cabinets. Opposite left and right side walls 15 and 17 extend downwardly from adjacent the side edges of the undersurface of top wall 11 and again are normally solid although they need not, of course, be constructed as a continuous surface. They can, if preferred, take the form of central wall sections mortised along their edges in separate corner posts and slightly recessed from the post faces. The cabinet can be supported in spaced relation to the floor by legs 19 depending from its corners therefrom although such legs can be dispensed with, the cabinet being extended downwardly to rest directly on the floor. In that case, the number of tray tables can be increased if desired or one or more conventional drawers can be provided, or the lower section of the cabinet can serve as storage space closed by hinged or sliding doors.

The front wall of the console or commode cabinet is so constructed as to define a plurality of slot-like openings 21 disposed in vertically spaced relationship with cross rails 23 situated therebetween. The ends of rails 23 are fastened to the front margins of the opposite side walls 15, 17. A similar cross rail 23 is present directly beneath the front edge of the top cabinet wall 11 so as to maintain a uniform spacing above and below the vertical series of openings 21.

Preferably, around the perimeter of the front and opposite side cabinet walls at a level below the lowermost of the slot-like openings in the front wall of the chest, an ornamental molding strip 25 may be provided, projecting laterally of the walls in question and bevelled if desired along its top edge as at 27 as an ornamental feature. Similarly, a skirtboard may depend downwardly below the ornamental strip 29 between the corner posts 19 along the two opposite side and front walls of the cabinet, and this skirtboard may likewise be bevelled along its lower front edge as at 31 in FIG. 1, and, furthermore, be contoured along its lower edge, as at 33, in an attractive design complementing the particular furniture style in which the cabinet of the invention is designed.

Figure 3:
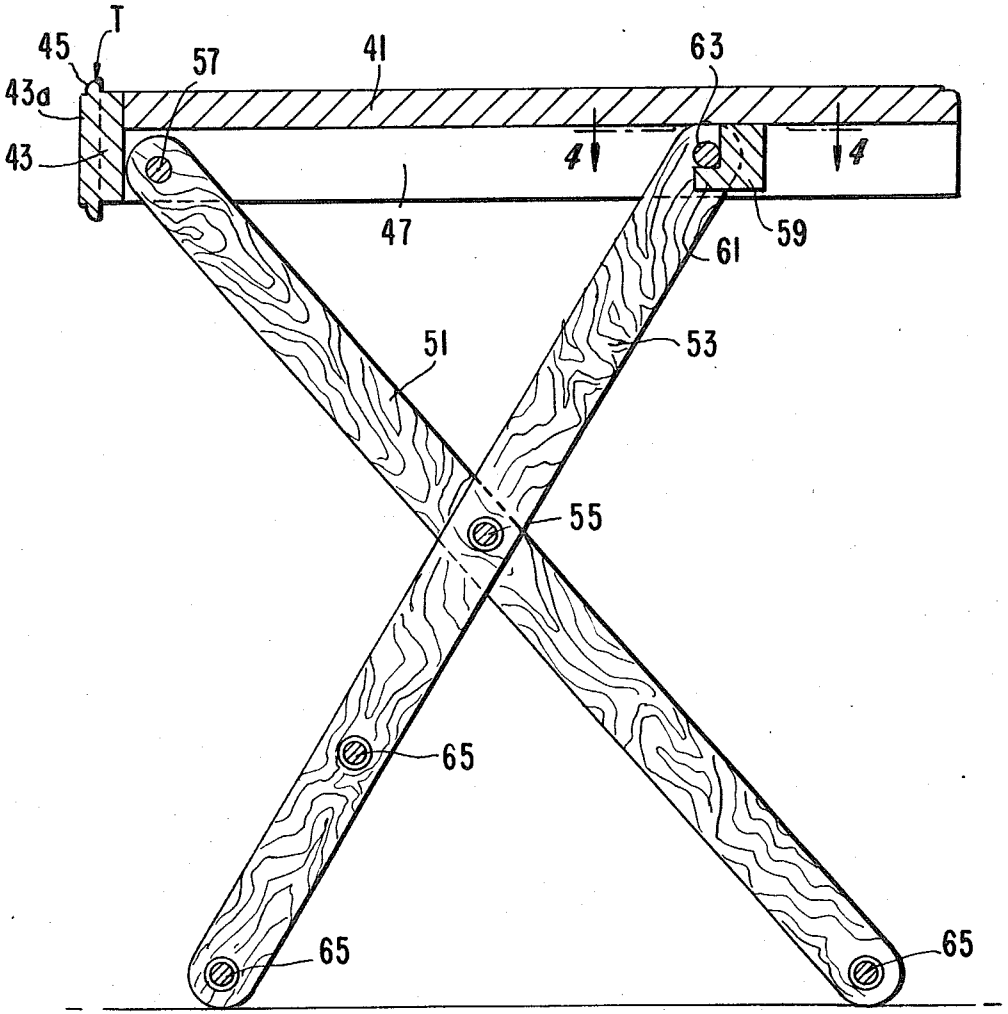
FIG. 3 is a right side elevational view of an individual tray table in erected, operative position taken in cross section therethrough from front to back.

The several slot-like openings 21 in the front wall of the cabinet C function to receive and contain for storage purposes a corresponding plurality of individual tray table units generally designated T, one of which is shown on an enlarged scale in erected position in FIG. 3. Each of the tray table units T of the invention includes a top panel 41 which is normally generally rectangular in shape and solid or continuous along its upper surface so as to form the table surface of the unit. Along the front edge of top panel 41 is connected a vertically extending front panel 43 extending below the underside of the top panel. When viewed in front elevation, as shown partially in FIG. 2, the height and width dimensions of each front panel 43 are so selected as to at least generally correspond with the same dimensions of the slot-like openings 21 and to pass with such opening through at least a part of the thickness. If desired, for ornamental purposes, each front panel 43 can include an exterior front section 43*a* which is enlarged compared to the opening dimensions so as to project beyond the opening on all sides, forming a flange-like extension which can be bevelled on the front face along its outermost edge as at 45. These extensions overlap with and intimately engage the front wall margins around the slot-like openings 21 in the cabinet and limit the extent of inward movement of the individual table units T within the corresponding slot-like opening 21. Alternatively, these flange-like extensions can be omitted so that the front panel of each individual unit is received essentially entirely within the front-like openings, undue inward movement of the individual tray unit being prevented by some other form of detent means (not shown). In any case, the area of the front panels is at least such as to essentially completely occupy the area of the corresponding slot-like opening 21 and thereby avoid unsightly gaps or spaces around the perimeter thereof.

Preferably, each individual tray table unit T also includes depending side panels 47 extending downwardly from the extreme lateral margins of the top panel 41 forming with the depending portion of the front panel 43 a skirt or apron around at least the opposite sides and front of the top panel. The height of the skirt or apron is sufficient to provide an attractive finished appearance around the sides of the tray table and, more importantly, to define a downwardly directed recess within which supporting legs for the table unit are adapted to be received and contained when in collapsed position.

Figure 4:
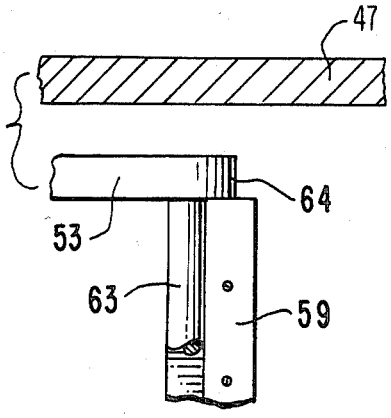
FIG. 4 is a detail view of the table of FIG. 3 showing a fragment or a horizontal sectional view with the top panel removed looking substantially along line 4—4 of FIG. 3.

The structure of the supporting legs can take various forms but preferably the legs are arranged in the manner illustrated in FIG. 3 of the drawings, consisting of front and back pairs of legs 51, 53 connected intermediate their respective lengths by means of a common pivot axis formed by a dowel rod 55 or the like so that the leg pairs intersect generally in the configuration of an X and are pivotable in scissors fashion. The upper ends of the front pair of legs 51 are pivotally fixed as at 57 to the underside of the top panel adjacent the back side of the front panel, such as by a common pivot rod or separate pivot pins embedded at the exterior ends thereof in the side panels or skirts where the latter are present. If the side skirts are absent, brackets attached to the top panel can anchor those ends. The upper ends of the back pair of legs have no fixed connection to the top or side panels of the table and are thus free to move horizontally relative thereto, thereby opening or closing the scissors-like arrangement of the hingedly connecting leg pairs. Detent means are provided on the underside of the top panel to limit the backward displacement of the upper ends of the rear leg pair; and while various forms of detent means could serve equally well for this purpose, a simple preferred embodiment therefor appears in FIG. 3. In this embodiment, a detent block 59 is affixed to the underside of the top table panel 41 at a point spaced rearwardly of front panel 43 usually in excess of one-half of the horizontal length of top panel 4, block 59 including a forwardly projecting lip 61 along the front side of its lower end so as to define a fixed notch-like anchor for engaging a dowel rod 63 extending for this purpose transversely of the upper ends of the rear leg pair 53. Inasmuch as the leg pairs 51, 53 must be capable of slidably fitting between the lateral ends of detent block 59 and the inner surfaces of the apron walls 47, sufficient clearance must be provided, as at 64 in FIG. 4, at both ends of the detent block to allow the upper leg ends to assume the position seen in FIG. 1.

Depending upon the mode of pivotal connection between the upper ends of the front leg pair 51 and the top panel of the table unit, the rear leg pair 53 may be located either on the outside or inside of the front leg pair. Where, as in the illustrative embodiment, the upper ends of the front leg pair are hinged to the side aprons of the table unit, the back leg pair must be disposed interiorly of the front leg pair as illustrated. If, in this case, the upper ends of the front leg pair are anchored by pivot pins terminating more or less flush with the inner surface of the upper ends of the front leg pair (not shown), then the upper ends of the rear leg pair can be coextensive with the upper ends of the front leg pair. However, where, as shown, the pivot takes the form of dowel pin 57 extending the full width between the table side or skirts, then the upper ends of the rear leg pair would be obstructed by the presence of the pin 57 from assuming a flat collapsed position generally coplanar with the front leg pair. In this event, the length of the top section of the rear leg pair 53 between the pivot axis and their upper extremities must be shortened relative to the length of the corresponding section of the front leg pair 51 so that the upper end of the rear leg pair is free to swing inside the pivot rod to a flat coplanar condition.

Preferably, the lower ends of each leg pair are braced apart by a dowel rod or stretcher 65 with two such bracing rods being provided on rear leg set 53. Obviously, where bracing rods are present at the lower ends of both leg pairs, the same problem of the inner (rear) leg pair being obstructed from moving to a fully flat position within the outer (front) leg pair, and this problem can be solved as before; namely, by reducing the length of the lower section of the inner leg pair relative to the length of the corresponding section of the outer leg pair to allow the legs to swing together to a flat condition. Notwithstanding the unequal lengths of the respective leg pairs as well as the unequal length of their respective leg pairs as well as the unequal length of their respective upper and lower sections, it is readily possible to so locate the center pivot axis 55 connecting the leg pairs together that the table will assume a generally horizontal presentation when the leg pairs are placed in downwardly directed X-shaped position, as shown in FIG. 3, and the table unit is in fully erect condition. In that condition, the legs will be stabilized by the engagement of the detent block 59 with the dowel rod 63 at the rear pair 53. The contour of the dowel rods can be cylindrical but preferably they are shaped as by turning on a lathe with varying diameters for enhanced attractiveness, and the presence of different diameters on these rods is suggested in the drawings.

Figure 2:
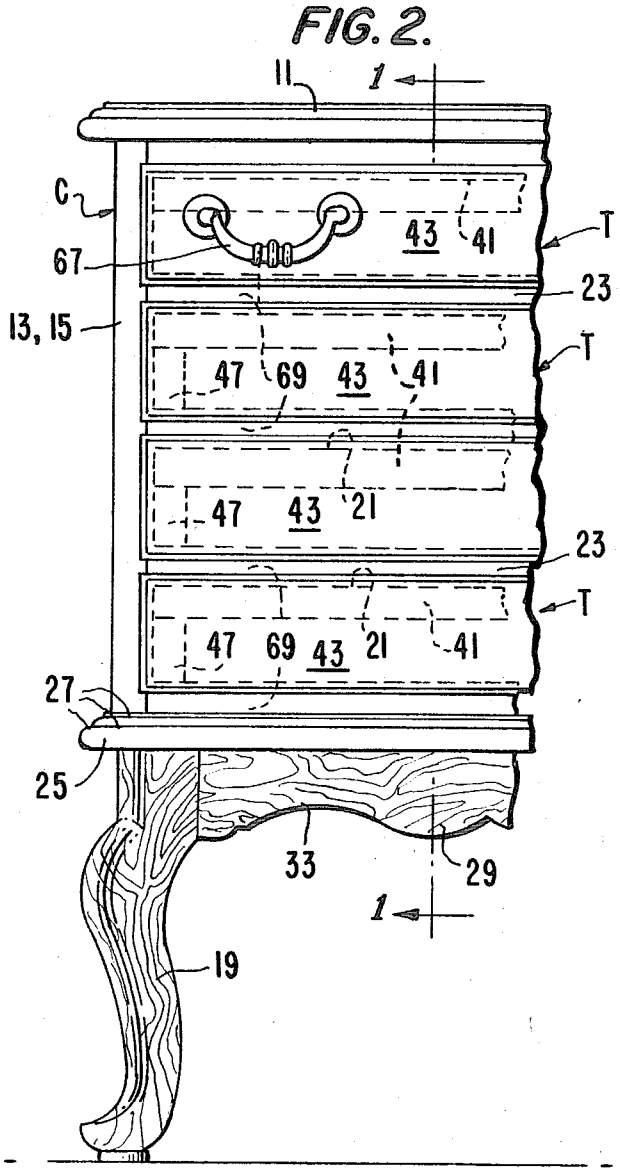
FIG. 2 is a partial front elevation of the assembly of FIG. 1 in which one end of the upper drawer is shown for illustration purposes, provided with an ornamental handle.

The front panels 43 of the various individual tray table units T will ordinarily be provided with handle means 67, only one of which is shown in FIG. 2 of the drawings, being otherwise omitted for sake of simplicity. The configuration of the handle means can vary widely according to the selected furniture style; and while a bale-type handle of a typical ornamental style is illustrated, other types of handles could be employed equally well including knobs and recessed blocks, to mention two possibilities. For purposes of illustration, the combined commode and tray table set of the invention has been shown in a recognized Early American style, but obviously, the invention is in no way restricted by the ornamental style applied thereto since the invention can be adapted equally well to many different recognized furniture styles.

As is apparent in FIG. 1 of the drawings, showing the tray tables T housed within the commode cabinet C, the preferred leg arrangement according to FIG. 3 when in collapsed position results in the lower sections of both leg pairs extending beyond the normal rear limit of the top table panel. Certainly the length of the latter could be increased to generally correspond with the length of the collapsed leg pairs, but such extra length is ordinarily not required and tends to give an awkward proportion to the top table panel. The rearward projection of the lower leg sections beyond the limit of the top table panel is in no way objectionable, the only consequence being a preferred construction of the cabinet side walls with a depth sufficiently great as to comfortably accommodate the full leg length. Obviously, the cabinet could be designed with a reduced length with its back wall left open and the lower leg sections protruding exteriorly thereof. However, such an arrangement, while economical in reducing the amount of wood needed for constructing the cabinet, may not be considered aesthetically desirable except in the case of decorating circumstances where the back side of the commode is obscured from view. Where the depth of the cabinet is sufficient to accommodate the full length of the collapsed legs, as is preferred, the commode cabinet C normally includes a back wall, giving a more finished look to the structure, although obviously the presence of a back wall is not essential.

In order to insure that the individual tray table units can be inserted and removed easily and smoothly to and from the corresponding slot-like cabinet openings 21 receiving the same, lateral guide means should desirably be included for slidably supporting the side margins of the collapsed table units T while the same enter and leave the slot-like opening. Again, different types of guide means would serve this function equally well, and one simple form consists of side rails 69 affixed at appropriate horiziontal planes on the interior of the cabinet side walls, generally coextensive in vertical height as well as interior projection with the vertical spacer rails 23 on the front wall of the cabinet, as indicated in dotted lines along the left side of FIG. 2. The front wall spacer rails 23 can be duplicated along the back wall of the cabinet, as at 71, for increased structure strength and rigidity as well as support of the extreme lower ends of the collapsed table legs in stored position.

Throughout the course of the preceding description, various options have already been described and additional options, variations and modifications will be entirely apparent to the skilled worker in the furniture field. Consequently, the invention should not be construed as restricted in its scope to the illustrated embodiment either with or without the disclosed alternatives but only as dictated by the express wording of the appended claims.

What is claimed is:

1. A console-housed tray table set comprising a console cabinet having a solid top wall, solid opposite side walls and front wall defining an interior, said front wall having at least one slot-like opening in the cabinet interior extending horizontially between said side walls; and for such opening a tray table removably stored within the cabinet interior via said horizontal slot-like opening, each such tray table having a solid top panel of a thickness substantially less than the height of said slot-like opening and a width less than the width thereof for reception within said opening, a front panel coneected to the front end of said top panel and projecting below the same at right angles thereto with an area at least generally coextensive with the corresponding slot-like opening so as to closed the same when the tray table is stored within said cabinet, a front pair of legs pivotally connected to said top panel along an axis extending in adjacent parallel relation to said front panel inwardly thereof and a back pair of legs pivoted to said front pair on an axis parallel to said front panel located intermediate the respective lengths thereof for relation scissor-like movement between an expaned generally x-raped erected position and a collapsed, flat position where one leg pair nestles within the other directly beneath and generally parallel to said top panel, said leg pairs in said collapsed position having a thickness not greater than the projection of said front panel below said top panel whereby said top panel and leg pair in said collasped position slidably fit within said slot-like opening projecting into the interior cabinet space, and including detent means depending from the undersurface of said top panel in horizontally spaced relation to said front panel to engage the upper end of the back leg pair when in said erected position and retain the erected leg pairs in downwardly extending tray supporting relation to said front panel to engage the upper end of the back leg pair when in said erected position and retain the erected leg pairs in downwardly extending tray supporting relation, said leg pasirs in collapsed condition having a length parallel to the plane to the top panel which substantially exceeds the corresponding distension of said top panel and the horizontal dimension of said cabinet interior is at least as great as the collapsed length of said leg pairs, one said pair of legs being shorter in length than the other said pair of legs and nestling with the longer leg pair when said leg parts are in collapsed position, said pivot axis pivotally connecting said leg pairs being located on the respective leg pairs at different distance from their corresponding ends, and the pivot axis being displaced along the lengths thereof from the midpoints of the respective leg pairs such that when said leg pairs are retained in said erected postion in downwardly extending tray-supporting relation, the leg pairs are asymmetrically disposed relative to vertical plane through their pivot axis while the lower ends of said leg pairs together define a plane parallel with said top panel, with the distance between the respective lower ends exceeding the distance between their upper ends, and said longer leg pair includes a transverse brace extending between the lower ends of the legs thereof and the lower ends of said shorter leg pair when in said nestled relation terminate inwardly clear of said brace whereby said leg pairs can collapse to said flat position without interference.

2. The tray table set of claim 1 wherein said cabinet top and side walls having a depth at least equal to the length of a tray table when the legs thereof are in collapsed position.

3. The tray table of claim 2 whrein said cabinet includes a back wall closing the rear of said cabinet while the tray tables are stored therein in collapsed condition.

4. The tray table of claim 1 wherein said cabinet is held spaced above the floor by generally vertically directed legs depending therefrom at its corners.

5. The tray table set of claim 1 wherein said cabinet includes guide means on the interior of the side walls thereof beneath the side margins of each of said slot-like openings and extending horizontally rearwardly from the cabinet front wall to guide the collapsed tray tables upon insertion into said openings for storage therein and maintain the stored tray tables in vertically spaced apart relation.

6. The tray table set of claim 1 wherein the front panel of each tray table has a height and width exceeding the height and width of said slot-like openings wherein said front panels project forwardly of said front cabinet wall.

7. The tray table of claim 1 wherein each of the front panels of said tray tables is provided with exteriorly accessible handle means to facilitate the storage and removal of said tables in said cabinet.

8. The tray table set of claim 1 wherein each of said tables has side panels depending from said top panel adjacent the opposite lateral extremities thereof with a height suitable to fit within said slot-like openings.

* * * * *

UNITED STATES PATENT AND TRADEMARK OFFICE

CERTIFICATE OF CORRECTION

PATENT NO. : 4,700,635

DATED : October 20, 1987

INVENTOR(S) : Leonard Eisen

It is certified that error appears in the above-identified patent and that said Letters Patent is hereby corrected as shown below:

In the Claims:

Claim 1, column 6, line 49, "closed" should read -- close --; line 55, "relation" should read -- relative --; and line 56, "x-raped" should read -- x-shaped --;

column 7, line 5, "pasirs" should read -- pairs --; line 15, "distance" should read -- distances --.

Signed and Sealed this

Second Day of February, 1988

*Attest:*

*Attesting Officer*

DONALD J. QUIGG

*Commissioner of Patents and Trademarks*